US008448974B2

(12) United States Patent
Huber et al.

(10) Patent No.: US 8,448,974 B2
(45) Date of Patent: May 28, 2013

(54) BOARD-LIKE SLIDING DEVICE IN THE FORM OF A SKI OR SNOWBOARD

(75) Inventors: Rupert Huber, Radstadt (AT); Helmut Holzer, St. Johann (AT); Georg Klausner, St. Johann (AT)

(73) Assignee: Atomic Austria GmbH (AT)

( * ) Notice: Subject to any disclaimer, the term of this patent is extended or adjusted under 35 U.S.C. 154(b) by 391 days.

(21) Appl. No.: 12/829,694

(22) Filed: Jul. 2, 2010

(65) Prior Publication Data

US 2011/0001305 A1 Jan. 6, 2011

(30) Foreign Application Priority Data

Jul. 6, 2009 (AT) ..... A 1050/2009

(51) Int. Cl.
*A63C 5/075* (2006.01)

(52) U.S. Cl.
USPC ..... 280/607; 280/609

(58) Field of Classification Search
USPC ..... 280/607, 609, 617, 618
See application file for complete search history.

(56) References Cited

U.S. PATENT DOCUMENTS

| | | | | |
|---|---|---|---|---|
| 3,260,531 | A | 7/1966 | Heuvel | |
| 3,260,532 | A | 7/1966 | Heuvel | |
| 5,393,086 | A | 2/1995 | Le Masson et al. | |
| 5,447,322 | A | 9/1995 | le Masson et al. | |
| 7,290,784 | B2 * | 11/2007 | Heil et al. | 280/617 |
| 7,497,460 | B2 * | 3/2009 | Baumgartner et al. | 280/607 |
| 7,503,578 | B2 * | 3/2009 | Poellmann | 280/607 |
| 7,946,608 | B2 * | 5/2011 | Riepler et al. | 280/602 |
| 8,172,251 | B2 * | 5/2012 | Holzer et al. | 280/602 |
| 2007/0205582 | A1 * | 9/2007 | Himmetsberger et al. | 280/609 |
| 2007/0205583 | A1 * | 9/2007 | Schary et al. | 280/609 |
| 2011/0001305 | A1 * | 1/2011 | Huber et al. | 280/607 |

FOREIGN PATENT DOCUMENTS

| | | | |
|---|---|---|---|
| AT | 504800 | A1 | 8/2008 |
| DE | 19836515 | A1 | 2/1999 |
| DE | 10126121 | A1 | 12/2002 |
| WO | 0010659 | A1 | 3/2000 |
| WO | 0062877 | A1 | 10/2000 |
| WO | 2004045727 | A1 | 6/2004 |

* cited by examiner

*Primary Examiner* — Jeffrey J Restifo
(74) *Attorney, Agent, or Firm* — Lerner, David, Littenberg, Krumholz & Mentlik, LLP

(57) ABSTRACT

The invention relates to a board-like sliding device in the form of a ski or snowboard. Said board-like sliding device comprises a multilayered sliding board body and at least one elongated force-transmitting element supported on the upper side of the sliding board body for influencing the bending resistance or the vibrational behavior of the sliding board body as well as a binding device for a potentially detachable connection with a sports shoe. Between the lower side of the force-transmitting element and the upper side of the sliding board body at least one engaging coupling means is formed. The force-transmitting element is designed in this case as a thin-walled shell body with a wall thickness of less than 5 mm, which at least over the main part of its longitudinal extension has a substantially U-shaped cross section. At least part sections of the side arms of the force-transmitting element run at least partly in groove-like depressions on the upper side of the sliding board body.

16 Claims, 3 Drawing Sheets

BOARD-LIKE SLIDING DEVICE IN THE FORM OF A SKI OR SNOWBOARD

BACKGROUND OF THE INVENTION

The invention relates to a board-like sliding device in the form of a ski or snowboard.

In AT 504 800 A1 of the same applicant a generic board-like sliding device is disclosed. In this case a board-like force-transmitting element is provided, which is supported on the upper side of the actual sliding board body. The upper side of the board-like force-transmitting element is provided for supporting a binding device, which is used to provide a detachable connection with a sports shoe. At least in the region of the binding assembly zone between the lower side of the board-like force-transmitting element and the upper side of the sliding board body at least one engaging connection is provided, which is formed by integral, strip and/or wart-like elevations on the lower side of the plate-like force-transmitting element and by corresponding groove-like depressions in the upper side of the sliding board body. Said engaging connection is positioned close to the longitudinal middle axis of the sliding board body, in particular aligned with securing screws for the assembly of jaw bodies of the binding device. The securing screws for mounting the jaw bodies of a binding device are anchored directly in the plate-like, relatively thick-walled force-transmitting element and the tips of the screws can extend into the strip and/or wart-like elevations on the lower side of the plate-like force-transmitting element, in order to achieve an increased resistance to tearing out. Furthermore, an increased resistance to the binding screws tearing out is achieved, in that the board-like force-transmitting element is formed by a multilayered composite body, which comprises a plurality of adhesively connected layers, between which at least one core element is arranged. By means of said at least one engaging connection positioned longitudinally centrally between the lower side of the plate-like force-transmitting element and the upper side of the sliding board body on the one hand rotational movements between the plate-like force-transmitting element and the sliding board body relative to a vertical axis can be reliably prevented and in addition an increased resistance to tearing out of the binding screws can be achieved. Owing to the increased effort involved in producing this virtually double-layered, board-like sliding device and the associated additional costs it is difficult to make the functionally advantageous, board-like sliding device accessible to the largest possible number of users.

U.S. Pat. No. 5,447,322 A describes a ski, which comprises a lower sliding board body and a longitudinally extended reinforcing element secured onto its upper side, which is coupled to the upper side of the sliding board body by means of a flexible and partly rigid connection. The lower sliding board body is defined by a standard ski structure, in which several strengthening layers and a core component are adhered to one another. The reinforcing element, which extends over more than 50% of the length of the sliding board body, according to a first embodiment, is designed to have a multilayered sandwich structure (FIG. 3), which is joined to the upper side of the sliding board body via an elastically flexible adhesive layer. Said multilayered, sandwich-like reinforcing element has a decorative cover layer on its upper side and on its side walls, which determines the external appearance of the reinforcing element. The multilayered sandwich structure of the reinforcing element is complex in terms of manufacturing technology and involves high production costs. Furthermore, the elastically flexible adhesion of the reinforcing element with the upper side of the sliding board body is difficult in terms of production technology and the resulting, mechanical behaviour of the ski is only satisfactory to a certain degree. According to a second embodiment (FIG. 4) it is proposed to form the reinforcing element from a composite material and to have a hat-like or omega shape cross section, wherein the two flanges of a essentially hat-like reinforcing element aligned parallel to the upper side of the sliding board body are adhered on the surface over an elastically flexible layer to the upper side of the sliding board body. Furthermore, it has been proposed to provide bridge-like support elements for the jaw bodies of a ski binding. Said bridge elements extend at right angles over the reinforcing element and are supported respectively on the longitudinal side edges of the sliding board body. The reinforcing element is disconnected in this way from the forces acting via the ski binding and the forces exerted by the ski binding transfer directly to the longitudinally side edges of the sliding board body. Said bridge elements require increased production costs and the connection of the bridge elements to the sliding board body is difficult in terms of production technology. Furthermore, the sliding board body in the connecting section is reinforced considerably by the bridge elements, whereby the performance of the whole construction is impaired.

Similar structures of a ski comprising a reinforcing profile that is hat-like in cross section and at least one bridge element bridging the reinforcing profile for supporting the ski binding are described in U.S. Pat. No. 5,393,086 A. The designs disclosed therein also have the aforementioned disadvantages.

DE 101 26 121 A1 describes a ski consisting of a ski basic body and a board-like upper part connectable with the latter via coupling devices. The board-like upper part is in this case connected via screw connections to the ski basic body, whereby between the distal end sections of the upper part and the ski basic body movement is allowed in longitudinal direction, so that on bending the ski there is no mutual stiffening. Otherwise, the board-like upper part lies flat on the planar upper side of the ski body. The plate-like upper part can also be designed in this case as a spring element, which in the region of the binding assembly area comprises a spacer, in order to ensure the support of the spring element relative to the upper side of the ski basic body. Also these previously known embodiments are unsatisfactory in practice.

WO 00/10659 A1 describes a further structural form of a board-like sliding device, which comprises substantially two components arranged on top of one another. In this case the upper part is formed by a profile element which is substantially C-shaped in cross section, which in connection with a guiding rail which is T- or I-shaped in cross section forms a mutual engaging connection on the upper side of the ski basic body. Said T- or I-shaped guiding rail which is provided for the detachable, interlocking connection with the longitudinal slot on the lower side of the C-shaped upper side, is integrated into the structure of the ski basic body. Said engaging connection opposes a spacing between the upper part and the ski basic body in vertical direction to the running surface of the ski basic body. At the same time by means of this engaging connection relative displacements between the upper part and the ski basic body in a plane running at right angles to the longitudinal direction and parallel to the running surface of the ski basic body are prevented. Also said embodiment is complex in terms of production technology and is unsatisfactory and relatively uneconomical with respect to the resulting overall costs.

Moreover the embodiments described in WO 00/62877 A1, WO 2004/045727 A1, DE 198 36 A1, U.S. Pat. No.

3,260,531 A and U.S. Pat. No. 3,260,532 A of board-like sliding devices do not satisfy the requirements of combining the highest possible performance with relatively low production costs.

BRIEF SUMMARY OF THE INVENTION

The underlying objective of the present invention is to create a board-like sliding device in the form of a ski or snowboard, which achieves the technical advantages of use or the improved performance of a multipart board-like sliding device composed in particular of an upper part and a lower part and which still involves low production costs.

Said objective of the invention is achieved by a board-like sliding device according to the features of claim 1. An essential advantage of the board-like sliding device according to the claims is that is provides excellent functionality and performance but can still be produced and constructed relatively economically. Mainly, the upper part of the board-like sliding device functioning as a force-transmitting element can be produced relatively economically, but still provides the desired, mechanical properties, which influence advantageously the mechanical properties of the underlying sliding board body. Despite the relatively thin-walled design of the force-transmitting element compared to the sliding board body in the form of a shell body the latter can absorb or transfer the forces and loads created in a reliable manner. The corresponding resistance to compression of the comparatively thin-walled force-transmitting element is mainly achieved by the essentially U-shaped cross section of the shell body. In particular, the buckling or deviation of the force-transmitting element in a direction remote from the upper side of the sliding board body is prevented effectively by the design according to the claims. Furthermore, the claimed, board-like sliding device can be constructed to be relatively light compared to designs known from the prior art, without causing problems of strength or stability. The relatively low overall mass of the shell body in connection with the underlying sliding board body also improves the performance of the board-like sliding device during its intended use. The characteristic force-transmitting element is thus relatively lightweight, sufficiently stable, easy to produce and advantageous in its action in connection with the sliding board body. Furthermore, the structural height of the board-like sliding device can be kept relatively low, since the side arms of the force-transmitting element run at least partly in groove-like depressions on the upper side of the sliding board body. In this way the lever actions occurring between the board-like sliding device and its user during the use of the board-like sliding device can be kept as low as possible, so that the risk of injury to the user can be kept as low as possible. Regardless of this, by means of the characterised steps the stability or effectiveness of the force-transmitting element can be increased in the assembled state, although its wall thicknesses can be relatively thin or much reduced in thickness.

Mainly by means of the further measures according to claim 2 relatively inexpensive and yet sufficiently stable force-transmitting elements can be developed. By means of using plastic and a forming tool, which shapes a substantially flat element made of plastic or a multilayered, planar plastic composite element under the effect of heat and pressure and possibly joins them into one piece, the production costs for the force-transmitting element can be significantly reduced. In particular, for each force-transmitting element relatively short production cycles can be achieved. This also reduces the costs required for producing the board-like sliding device.

By way of the measures according to claim 3 the robustness of the board-like sliding device or its shell body arranged on the upper side is increased significantly. In particular, in this way despite the relatively thin walls of the shell body a high degree of breaking strength is achieved, as the lower side of the shell body on the upper side of the sliding board body can support in a load-transferring manner. Mainly in the binding assembly area, in which increased stress can occur, for example owing to the binding bodies or a sports shoe to be inserted into the binding, the risk of breaking or damaging the thin-walled shell body can be minimised or much reduced. In particular, also under the effect of impact, for example from a sports shoe, which is usually made of hard plastic, the forces coming from the thin-walled shell body, which is preferably made of plastic, can be absorbed easily.

Also the measures according to claim 4 produce a shell body, which easily resists the occurring stresses. Furthermore, the mass of the overall structure is reduced or kept as low as possible and despite this the required stability and the desired bending resistance of the overall structure is achieved.

Also the development according to claim 5 is particularly advantageous, as in this way the shell body is disconnected from vertical stresses coming from the binding device, or at least partly disconnected. In this way the planned mechanical cooperation between the force-transmitting element and the sliding board body is improved. Moreover, the stresses or control forces exerted by the user of the board-like sliding device act directly on the sliding board body, thereby improving the control or sliding behaviour. Furthermore, the relatively thin-walled shell body is also protected from excessive stress and the risk of breakage or damage to the latter is effectively minimised.

By way of the measures according to claim 6 the number of components required for the structure of the sliding device can be kept as small as possible, which has a positive effect on the total production costs. Furthermore, in this way a direct transfer of force or mechanical coupling between the binding device and the sliding board body sliding on the respective ground surface is achieved.

An embodiment according to claim 7 is also advantageous, as in this way the upper side of the sliding board body can be designed to be relatively flat and in its original state or after production has no platform-like elevations, which would have a disadvantageous effect on the production process. In particular, by means of the separately designed support elements, which are preferably combined into a structurally independent insertion part, an abrupt elevation is avoided on the upper side of the sliding board body. In this way the grinding of the running surface coating of the sliding board body is simplified or a higher-grade grinding process is made possible, as no platform-like elevations are formed, which would have a negative effect on the grinding of the running surface coating. By means of the separate design of an insertion part or of support elements the grinding process of the sliding board body can thus be performed, without significant, platform-like elevations being formed on the upper side of the sliding board body, whereby the grinding appearance of the running surface coating is improved.

By way of the measures according to claim 8 a simplified assembly of the board-like sliding device is achieved. Furthermore, locally delimited depressions in the upper side of the sliding board body do not affect or only marginally affect the grinding result or the grinding quality of the running surface coating.

Also by way of the measures according to claim 9 an extremely robust embodiment is created which facilitates and allows the formation of a relatively thin-walled shell body as the force-transmitting element. In particular, in this way a relatively large hold-down area is created, which secures the shell body inside the assembly section for a binding device against lifting. By means of the relatively large area lower side of the binding device or their guiding devices or also a binding plate for the binding device it is ensured that the force distribution occurs over as large an area as possible and point-like peak stresses against the thin-walled shell body are avoided.

By way of the measures according to claim 10 in sections straining between the lower side of the binding device and the shell body is avoided. In this way as far as possible a uniform or harmonious bending characteristic is achieved for the shell body and then for the board-like sliding device, whereby positive effects can be achieved relating to the driving or sliding behaviour of the board-like sliding device.

Furthermore, the measures according to claim 11 are advantageous, as in this way the necessary resistance to tearing out of the securing screws of the binding device or their guiding rail arrangements or binding plates can be achieved or ensured easily. In particular, the securing screws can be reliably anchored in the sliding board body, which compared to the thin-walled shell body has a much greater thickness, or can be screwed into the latter in a standard manner. The relatively thin-walled shell body, which could only provide the required resistance to tearing out with difficulty is thus completely released from having a holding function for the binding device. Furthermore, in this way a direct force coupling which is thus as delay-free as possible is formed between the binding device and the sliding board body essential for the track guiding.

By way of the measures according to claim 12 unwanted gaps formed between the lower delimiting edges of the shell body and the upper side of the sliding board body are prevented in a simple, but effective and reliable manner. Furthermore, in this way snow or ice is prevented from collecting between the shell body and the sliding board body. An essential advantage of the claimed measures is also that rattling or impact noises are avoided or can be kept to a minimum during the use of the sliding device, in particular when moving over bumpy or rough ground. Furthermore, in this way the inherent bending elasticity or bending resistance of the shell body is transmitted to a certain degree to the underlying sliding board body.

By way of the measures according to claim 13 it is possible to design the shell body to have a relatively thin wall, so that it easily withstands the occurring bending stresses. In addition, the effect or influence of the force-transmitting element relative to the sliding board body is sufficiently defined and effective. In particular, the shell body represents an element which is subjected to pushing or pressure of tension, whereas the sliding board body withstands the bending stresses usually occurring during use and is dimensioned primarily with respect to the required bending resistance or breaking limits.

The measures according to claim 14 are also particularly advantageous. In particular, in this way technical production advantages can be achieved, which have a positive effect on the desired reduction of production costs. Since the end sections of the arms facing away from the central base section of the shell body run at least partly in the groove-like depression on the upper side of the sliding board body and thus can only be seen partly if at all, a special processing or expensive finish on the free arm ends can be omitted. Usually it is sufficient to design the free arm ends to be ridge-free or to be ready for use with a simple and rapid grinding process. Since the free arm ends cannot be seen visually or only on close observation, their appearance is not particularly relevant. A correspondingly designed board-like sliding device can therefore be produced at the lowest possible cost. A further significant advantage of this design is that the free arm ends of the relatively thin-walled shell body or the relatively sharp-edged end sections of the arms cannot cause injury to the user or third parties, since the latter run at least partly in the groove-like depressions on the upper side of the sliding board body.

Also the measure according to claim 15 is an advantage, as in this way the relatively, flexible shell body which can be bent much more easily than the sliding board body is protected from unwanted lifting movements or gap formations relative to the upper side of the sliding board body. Furthermore, the attachment of a plurality of connecting zones spaced apart from one another in the longitudinal direction of the force-transmitting element can be converted relatively easily and inexpensively in terms of production technology. In addition, the risk of breaking the shell body is minimised, if at least its end sections are connected to the sliding board body so that at least one lifting movement is prevented relative to the upper side of the sliding board body. Furthermore, by way of said measures lateral deviation movements between the shell body and the sliding board body, in particular deviation movements are minimised or prevented in a plane running parallel to the running surface coating.

Lastly, a development according to claim 16 is also an advantage, as in this way bending-related relative displacements between the force-transmitting element and the sliding board body in relation to the longitudinal direction of the sliding board body are opposed by elastically flexible resistance. In particular, such relative displacements are cushioned and after covering a defined relative displacement path are gradually delimited. Said movement delimitation is thus dependent on stress and force. Mainly if the occurring deformation force is no longer sufficient to overcome the elastic deformation resistance a relative movement dependent on the bending between the force-transmitting element and the sliding board body is gradually stopped.

BRIEF DESCRIPTION OF THE DRAWINGS

For a better understanding of the invention the latter is explained in more detail with reference to the following Figures.

In a much simplified schematic representation.

DETAILED DESCRIPTION

Figure 1:
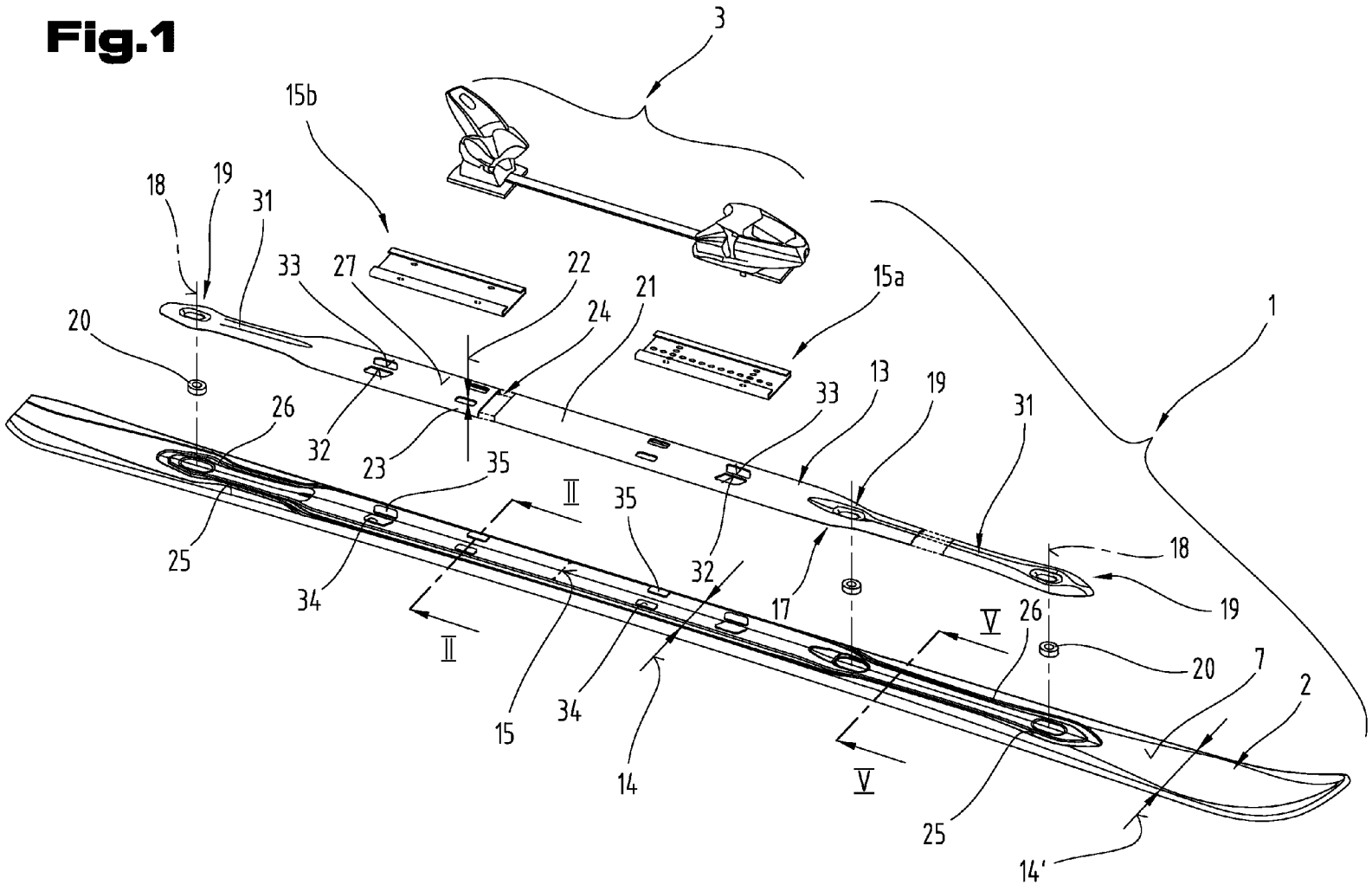
FIG. 1 shows a board-like sliding device, in particular a ski, comprising an upper element and a lower board or plate-like body in a partly exploded view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

FIG. 1 shows a preferred embodiment of a board-like sliding device 1 with improved driving properties, in particular significant damping or cushioning properties in explosive view in a schematic form. In particular, a ski 2 is shown, the sliding and curved behaviour of which and the inherent dynamics of which are advantageous for a plurality of users, whereby in the attached Figures only the most essential components have been shown by way of example. Furthermore, in the individual Figures only the most essential components have been shown, in particular the sliding board basic body and the plate or strip-like force-transmitting element.

Preferably, the board-like sliding device 1 defines a ski 2 or a snowboard. In a known manner a ski 2 of this kind is used in pairs, whereas a snowboarder is supported on both feet on a single sliding board body. To connect the feet of the user to the sliding device 1 the latter comprises at least one binding device 3, which can be designed as a safety-release binding or as an inflexible connecting binding.

Figure 2:
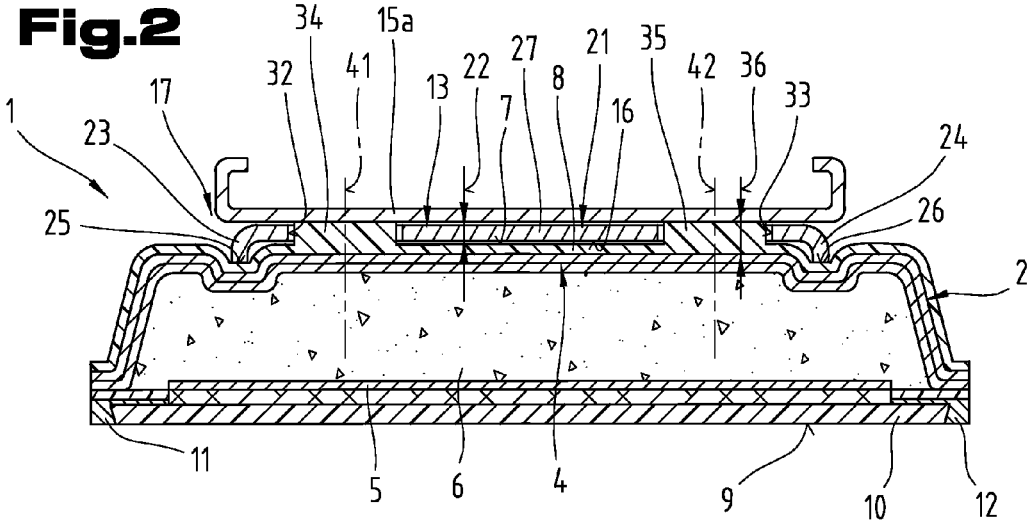
FIG. 2 shows the board-like sliding device according to FIG. 1 in its partly assembled state, in cross section along the lines II-II in FIG. 1.

The ground-side sliding board body of the sliding device 1 is designed to have a sandwich or single shell structure, as illustrated in FIG. 2 by way of example. This means that a plurality of layers are adhered to one another and together form the one-piece basic body of the sliding device 1. In a known manner said layers form at least one strength-related upper layer 4, at least one strength-related lower layer 5 and at least one core 6 arranged in between. The upper layer 4 and/or the lower layer 5 can thus consists of at least one plastic layer and/or metal layer and/or fibre layer and/or epoxy resin layer or the like. The core 6 can—as already known—be made of wood and/or foamed plastic. The core 6 thus spaces apart substantially the strength-related upper layer 4 from the strength-related lower layer 5 of the sliding device 1. Of course, it is also possible to design the sliding board body as a hollow body or with a hollow profile.

The upper side 7, i.e. the upper exterior face of the sliding board body is formed by a cover layer 8 which mainly has a protective and decorative function. The lower side 9, i.e. the bottom surface of the sliding board body is formed by a running surface coating 10, which as far as possible has good sliding properties relative to the corresponding ground, in particular snow or ice. The cover layer 8 can extend at least in sections also over the side walls of the sliding board body and together with the running surface coating 10 form a box-like structure, as can be seen mainly from the cross sectional view according to FIG. 2. The side edges of the running surface coating 10 are preferably delimited by control edges 11, 12, preferably made of steel, in order to allow on relatively hard ground the exact and largely slip resistant guiding of the sliding device 1. The control edges 11, 12—FIG. 2—essential for the control or guiding of the sliding device 1 are rigidly connected to the structure, in particular with the running sole or the lower layer 5 of the sliding board body. Preferably, the control edges 11, 12—as already known—is secured in a form and force-closed manner in the sliding device structure. Similarly, the running surface coating 10 is securely connected over its entire flat side facing the core 6 to the sliding device structure, in particular to its lower layer 5. Preferably, the running surface coating 10 is adhered over the entire surface to the surrounding structural elements of the sliding board body.

The structure described above essentially determines the strength, in particular the bending behaviour and the torsion resistance of the lower or ground-side sliding board body. Said strength values are predetermined and predefined by the materials used and the layer thicknesses and layer geometries and by the connecting methods used.

As can best be seen from FIG. 2, the cover layer 8 of the sliding board body is preferably made from a plastic layer which is decorated on at least one side. Said cover layer 8 thus forms most of the part section of the upper side 7 of the sliding board body. Preferably, said cover layer 8 also covers at least part sections of the outer longitudinal side walls. The respective layers can of course also be designed to be in multiples or individual layers can also be combined functionally.

On the upper side 7 of the sliding board body an elongated force-transmitting element 13 is supported at least within part sections in a force or load-transferring manner on the sliding board body. A structurally predefined shaping or lateral shape of the sliding board body thus results in a width 14 or 14' of the sliding device 1 and/or the force-transmitting element 13 that varies in the longitudinal direction of the sliding device 1, as best seen from FIG. 1. The width of the board-like force-transmitting element 13 is in this case preferably selected to be smaller in all longitudinal sections than the corresponding width 14, 14' of the sliding board body within the same or congruent longitudinal section. Preferably, the force-transmitting element 13 does not project over the longitudinal side edges of the sliding board body. In this way despite a highly effective force-transmitting element 13 a high degree of safety of the sliding device 1 can be achieved with regard to personal injury.

According to an alternative embodiment the force-transmitting element 13 can also be designed to taper in the form of a wedge, arrow or step in relation to at least one of its distal end sections, as indicated in FIG. 1.

By means of the force-transmitting element 13 significant changes in the driving behaviour are achieved, mainly with regard to the sliding behaviour and the inherent dynamics or the so-called "rebound" after the removal of load from the sliding device 1, as occurs in particular at curve exits, without structurally complex expensive measures having to be taken which considerably increase the weight of the ski 2. The suitably changed driving behaviour of such a ski 2 can also be recognised or sensed by a user of an average ability or by users who only practice sport occasionally. In this way the user acceptance can be increased and the pleasure of using such skis 2 can be increased significantly.

Preferably, the force-transmitting element 13 extends from the binding assembly section in the direction of the rear end section and in a direction towards the front end section of the sliding board body, as can best be taken from the view according to FIG. 1. In this way it is possible to change significantly or influence clearly the driving behaviour of the sliding board body by means of the force-transmitting element 13.

The distal ends of the force-transmitting element 13 can be moved relative to the upper side 7 of the sliding board body in its longitudinal direction, so that relative displacements between the force-transmitting element 13 and the sliding board body are allowed when the corresponding siding device 1 is subjected to downwards or upwards bending.

The force-transmitting element 13 is supported within its longitudinal extension at least in part sections on the upper side 7 of the sliding board body in a load or force-transferring manner. According to a first embodiment the lower side of the force-transmitting element 13 is supported virtually over the entire surface on the upper side 7 of the sliding board body. According to an advantageous embodiment it is also possible to provide on the lower side of the force-transmitting element 13 separately arranged support zones relative to the upper side 7 of the sliding board body. In this case at least in the end sections of the force-transmitting element 13 the support zones are positioned, such that the force-transmitting element 13 at least in its end sections is supported in a load or force-transferring manner on the sliding board body arranged underneath.

To achieve advantageous effects it is expedient if the force-transmitting element 13 extends from a binding assembly centre point 15 provided by the manufacturer of the sliding board body over more than 50% of the length up to the rear end of the sliding board body and at the same time extends over more than 50% of the length up to the front end of the sliding board body. It is preferable, if the force-transmitting element 13 extends over 51% to about 96%, preferably over 66% to 86% of the projected length of the sliding board body. The projected length is in this case the length of the sliding board body in a view from above. The longitudinal extension of the force-transmitting element 13 is limited essentially in that the force-transmitting element 13 does not extend into the upwardly curved blade section or end section of the sliding board body, so as not to restrict the relative displacements between the ends of the force-transmitting element 13 and the sliding board body, if the leaf-spring-like package of the force-transmitting element 13 and sliding board body is subjected to bending downwards or lifting of the binding assembly section or the middle section relative to the end sections. In particular, the upwardly curved blade section of the sliding board body would lock relative to the face end of the force-transmitting element 13 or restrictive forces would occur, if the force-transmitting element 13 in a straight or upwardly curved form extends into the blade section of the sliding board body. In particular, if the force-transmitting element 13, which can also be designed is sections for example to be board-like, extends over two thirds up to about nine tenths, for example over about three quarters of the length of the sliding board body between the binding assembly centre point 15 and the respective end of the sliding board body or with respect to the overall length of the sliding board body, a good relationship can be achieved between the weight optimisation and stability or functionality of the entire sliding device 1.

As best shown in FIG. 1, the force-transmitting element 13 is arranged between the sliding board body and the binding device 3 for the shoe of a user. In particular, above the force-transmitting element 13 a binding device 3 is arranged. The binding device 3 can in this case comprise a toe and heel jaw, which are connected either directly or with the interconnection of a guiding rail arrangement 15*a*, 15*b* to the sliding board body. The binding device 3 is thus supported on the actual sliding board body with the interconnection of the board or strip-like force-transmitting element 13.

Figure 3:
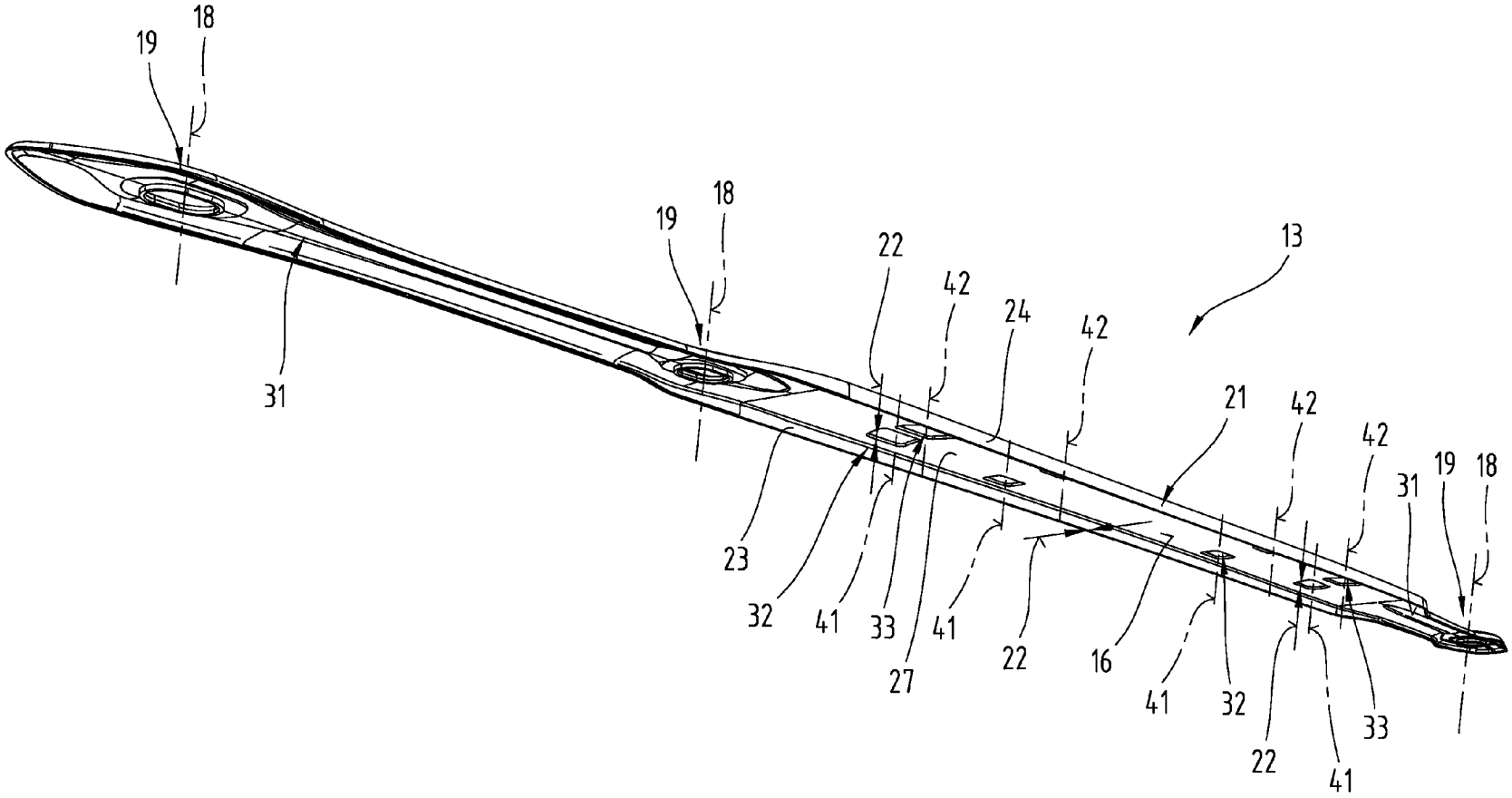
FIG. 3 shows an embodiment of a force-transmitting element designed in the form of a shell body, as used in the design according to FIG. 1, in perspective view from below.

As best shown from an overview of FIGS. 1 and 2, it is expedient to provide between the lower side 16 of the force-transmitting element 13 and the upper side 7 of the sliding board body at least one engaging coupling means 17. Said engaging coupling means 17, preferably formed in pairs between the force-transmitting element 13 and the upper side 7 of the sliding board body, extends preferably along the circumferential area of the force-transmitting element 13, as best shown in FIGS. 1 and 3.

The engaging coupling means 17 is thus designed such that it allows mutual longitudinal displacements or compensating relative movements between the force-transmitting element 13 and the sliding board body in the longitudinal direction of the sliding board body, when the sliding board body and the force-transmitting element 13 is subjected to bending downwards, as occurs for example when driving over troughs. According to an advantageous, optional embodiment the engaging coupling means 17 is also designed so that it prevents relative displacements between the force-transmitting element 13 and the sliding board body in transverse direction to the longitudinal extension and substantially parallel to the running surface coating 10 of the sliding board body or opposes such displacement tendencies with increased resistance. This means that the at least one engaging coupling means 17 allows relative displacements between the force-transmitting element 13 and the sliding board body in the longitudinal direction of the sliding board body, but prevents lateral deflection movements between the force-transmitting element 13 and the upper side 7 of the sliding board body, as can also be seen from an overview of FIGS. 1 and 2. This partially acting engagement between the force-transmitting element 13 and the sliding board body can thus cause a direct or undelayed transfer of forces between the force-transmitting element 13 and the sliding board body, without the sliding board body being blocked in its bending behaviour by the force-transmitting element 13.

The engaging coupling means 17 between the lower side 16 of the force-transmitting element 13 and the upper side 7 of the sliding board body can also be designed such that a defined lateral play is formed between the respective engaging elements, in order to avoid jamming and also under adverse conditions of use, such as for example under the influence of ice or snow, to prevent freezing between the force-transmitting element 13 and the sliding board body. This means that the engaging coupling means 17 between the force-transmitting element 13 and the sliding board body need not represent a play-free lateral guiding or guiding slide. Rather a relatively play-associated engagement between the force-transmitting element 13 and the sliding board body, as can be taken from the views according to FIGS. 4 and 5 by way of example, is defined as the engaging coupling means 17. A mutual coupling by means of the coupling means 17 is provided if the force-transmitting element 13 and the sliding board body engage with one another or pass into one another partly, as can be seen by way of example from the views according to FIGS. 1, 2 and 4, 5.

A sufficiently play-free guiding or adequate prevention of lateral relative adjustments between the force-transmitting element 13 and the sliding board body, i.e. adjustment movements in transverse direction to its longitudinal axis and in relation to a plane running parallel to the running surface coating 10, can be achieved or supported independently by an engaging coupling means 17 or in combination with an engaging coupling means 17 by at least one screw connection 18 between the force-transmitting element 13 and the sliding board body. Preferably, several screw connections 18 spaced apart from one another in the direction of the longitudinal axis of the force-transmitting element 13 are provided between the said parts, as shown in FIG. 1 by way of example. In the shown exemplary embodiment at least the distal end sections of the force-transmitting element 13 are connected or screwed together via a screw connection 18 to the sliding board body.

At least one end section, in particular the front end section of the force-transmitting element 13, is connected via an additional screw connection 18 to the sliding board body, since the front end section of the force-transmitting element 13 in comparison to the rear end section of the force-transmitting element 13 is dimensioned or designed to be comparatively longer. This means that the force-transmitting element 13 is connected to the sliding board body by a plurality of connecting zones 19 spaced apart from one another in the longitudinal direction of the force-transmitting element 13. In the shown exemplary embodiment three connecting zones 19 are provided in which respectively there is a screw connection 18 with the sliding board body. According to a preferred embodiment at least the distal connecting zones 19 are designed as longitudinal guides, which allow a relative displacement between the force-transmitting element 13 and the sliding board body as a result of the sliding board body bending upwards or downwards, but prevent lateral deviating movements or lifting movements between the sliding board body and the force-transmitting element 13 as far as possible.

According to a practical embodiment within at least one connecting zone 19 an elongated opening or longitudinal hole is formed in the force-transmitting element 13, which is passed through by a suitable screw connection 18, so that longitudinal equalisation movements are allowed within the respective connecting zone 19, if the board-like sliding device 1 is subjected to bending downwards or upwards. According to an advantageous development within at least one connecting zone 19 an elastically flexible connecting means 20 is formed in the longitudinal direction of the sliding board body, as shown schematically in FIG. 1. Said elastically flexible connecting means 20 can be formed for example by a block made from an elastomer plastic, which is inserted into at least one elongated opening of the force-transmitting 13 and opposes displacement movements caused by bending between the force-transmitting element 13 and the sliding board body in the longitudinal direction of the sliding device 1. The elastically flexible connecting means 20 is passed through by the screw connection 18, whereby in relation to the longitudinal direction of the sliding device 1, preferably in front of and behind the corresponding shaft of the screw connection 18 the elastically flexible connecting means 20 is arranged. In particular, the connecting zones 19 or their screw connections 18 can be designed according to the disclosures in AT 504 800 A1, which is of the same applicant.

It is essential that the force-transmitting element 13 is designed to be a relatively thin-walled shell body 21. It is advantageous, if the shell body 21 has a wall thickness 22 of less than 5 mm. The shell body 21 can thus also have a varying wall thickness 22, whereby the average wall thickness 22 or most of the wall thickness 22 of the shell body 21 is less than about 5 mm. The shell body 21 defining the force-transmitting element 13 is preferably made of plastic or a plastic-composite material. The shell body 21 that is relatively thin compared to the sliding board body comprises at least within the main part of its longitudinal extension a profile-like, in particular a U-shaped cross section, so that in comparison to a planar or board-like element it has increased resistance to thrust or compression relative to its longitudinal extension. By means of such a profile-like shell body 21 with a relatively narrow wall thickness 22 any unwanted buckling or deviation of the force-transmitting element 13 can be impeded and at the same time a particularly light-weight force-transmitting element 13 can be created. The preferably U-shaped cross section of the shell body 21 within the most part of within its entire longitudinal extension defines a particularly advantageous design of the shell body 21.

Figure 5:
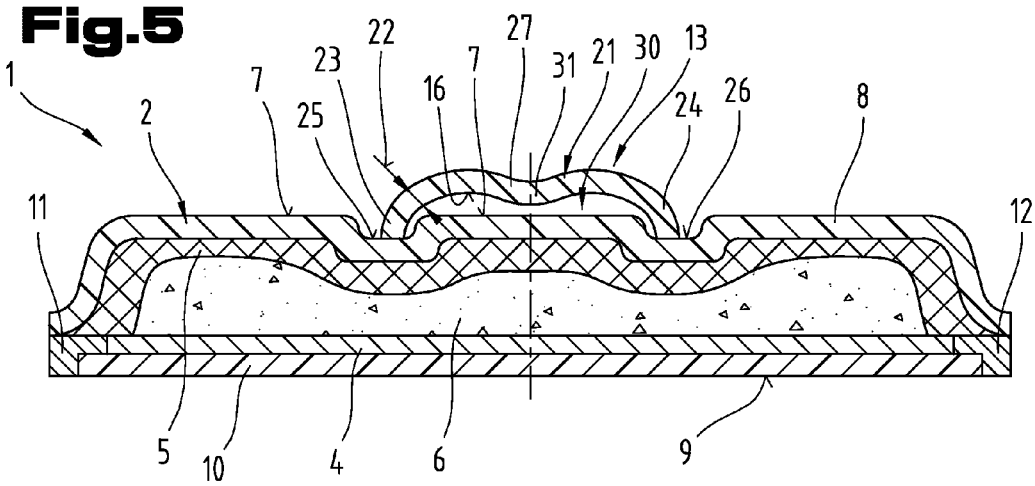
FIG. 5 shows the board-like sliding device according to FIG. 1 in a partly assembled state in a section in front of the binding device, in cross section according to lines V-V in FIG. 1.

According to a preferred embodiment, as illustrated in FIG. 3, the shell body 21 is designed in the manner of a half shell. This means that it preferably has a circumferential web, which projects from a central web or base section 27 of the shell body 21. Of course it is also possible to design individual part sections of the force-transmitting element 13 to be board-like or curved in cross section (FIG. 5).

It is particularly expedient in this case to allow to run or arrange at least part sections of side arms 23, 24 of the force-transmitting element 13 that is substantially U-shaped in cross section at least partly in groove-like depressions 25, 26 on the upper side 7 of the sliding board body. In this way the shell body 21 in relation to its cross section defines substantially the form of an inverted U-profile, which is fitted onto the upper side 7 of the sliding board body. In particular, the free end sections of the arms 23, 24 of the shell body 21 face the sliding board body. The groove-like depressions 25, 26 in the upper side 7 of the sliding board body are essentially congruent to the arms 23, 24 of the force-transmitting element 13, as can best be seen from FIG. 1. A width of the groove-like depressions 25, 26 is greater mainly in the overlapping area with the distal end sections of the force-transmitting element 13 than the wall thickness 22 of the shell body 21, so that the respective arms 23, 24 can perform relative movements within the groove-like depressions 25, 26. This means that the width of the groove-like depressions 25, 26 in relation to the respective longitudinal sections of the sliding board body is selected such that as far as possible there is an unhindered longitudinal equalisation between the force-transmitting element 13 and the sliding board body, when the correspondingly assembled board-like sliding device 1 is subjected to typical bending downwards or upwards.

Figure 4:
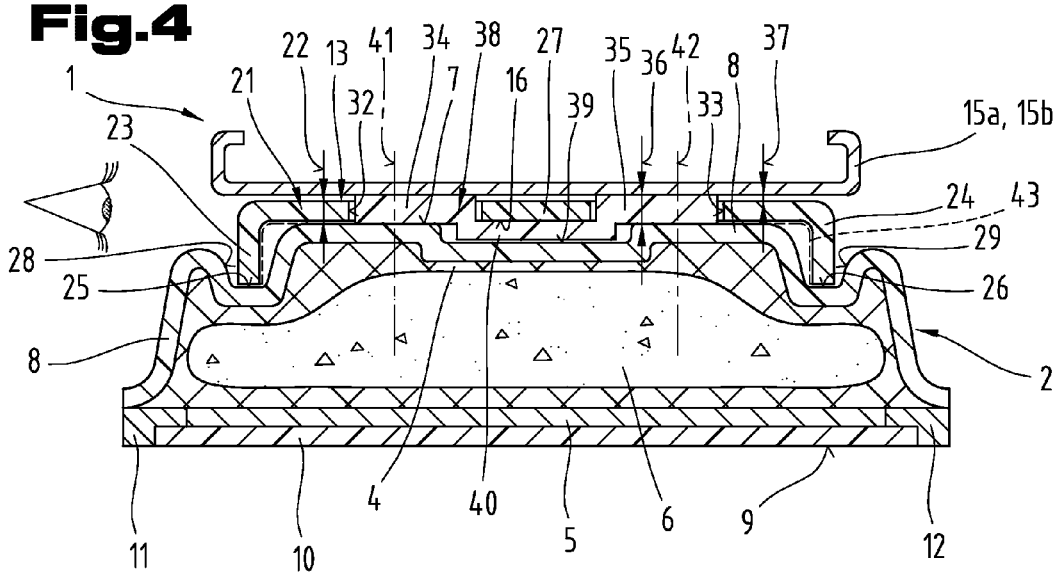
FIG. 4 shows a further embodiment of a board-like sliding device in cross sectional view in the region of the binding assembly area with a shell-like force-transmitting element formed on the upper side.

The height of the arms 23, 24 measured at right angles to the running surface coating 10 can thus be smaller than the depth of the groove-like depression 25, 26 measured in the same direction. This means that the end sections of the arms 23, 24 facing away from the central base section 27 of the substantially U-shaped shell body 21 can run at a distance from the base or bottom of the groove-like depressions 25, 26, as indicated in FIG. 4. Furthermore, it is not necessary for the entire height extension of the arms 23, 24 to run within the groove-like depressions 25, 26. Rather height and/or length-related part sections of the arms can also run outside the groove-like depressions 25, 26, as can be seen in FIGS. 4 and 5 by way of example.

The width of the central base section 27 of the shell body 21 at right angles to the longitudinal direction of the sliding device 1 is a multiple, preferably at least 5 times, in particular 8 times to 15 times the height of the arms 23, 24, whereby the width of the base section 27 can vary in relation to different longitudinal sections, as illustrated in the strip or arrow-shaped force-transmitting element 13 according to FIG. 3. It is also expedient to make the height or thickness of the sliding board body in the region about the binding assembly entre point 15—FIG. 1—between 15-25 mm, preferably about 20 mm, whereas the wall thickness 22 of the relatively thin-walled force-transmitting element 13 is between 2-5 mm, preferably about 3 mm.

As can best be seen from FIGS. 2 to 5 by way of example, the relatively thin-walled shell body 21 of the force-transmitting element 13 is designed and aligned relative to the sliding board body, such that the free end sections of the arms 23, 24 of the shell body 21 facing away from the central base section 27 of the U-shaped shell body 21 run respectively into the groove-like depressions 25, 26 on the upper side 7 of the sliding board body and are thus at least partly covered by the delimiting or side walls 28, 29 of the groove-like depressions 25, 26. Since at least parts of the end sections of the arms 23, 24 facing away from the central base section 27 are covered or cannot be seen or can only be partly seen, its optical appearance is of lesser importance, so that complex processing is unnecessary and the production costs for creating the corresponding force-transmitting element 13 or the entire sliding device 1 can be reduced in an advantageous and effective manner. Despite this the technical effects of the generic sliding device 1 are retained to a large degree or the effect of the force-transmitting element 13 remains uninfluenced.

As can best be seen from FIG. 2, it is expedient to support the lower side 16 of the shell body 21 at least within the assembly section for a binding device 3—FIG. 1—in a load-transferring manner of the upper side 7 of the sliding board body. In particular the lower side 16 of the central base section 27 can be supported on the upper side 7 of the sliding board body. Alternatively or in combination therewith the ends or edges of the arms 23, 24 facing away from the central base section 27 of the shell body 21 can be supported on the groove base or bottom of the groove-like depressions 25, 26 in a load-transferring manner. In this way forces which occur in the end sections of the force-transmitting element 13 are transfer into the central area of the sliding board body, i.e. into the assembly section for a binding device 3—FIG. 1.

Alternatively or in combination therewith it is expedient to provide in at least one end section of the shell body 21 a hollow chamber 30, which is formed between the lower side 16 of the shell body 21 and the upper side 7 of the sliding board body. For this it is expedient to design the shell body 21 inside the corresponding longitudinal sections to be almost curved in cross section, whereby the lateral edge sections of the shell body 21 are much more angled or curved relative to the central base section 27, in order to form the almost U-shaped contour with the side arms 23, 24. An exemplary embodiment relating to this is shown in FIG. 5, whereby in the central base section 27 if necessary also a reinforcing rib or reinforcing bead 31 can be formed. In this way the bending resistance of the relatively thin-walled shell body 21 and also thus the capacity for transferring thrust forces, from at least one end section of the shell body 21 in the direction of its middle section or binding assembly section can be increased or improved. In this case it is also possible that the at least one reinforcing rib or reinforcing bead 31 is supported with its lower side or lower edge on the upper side 7 of the sliding board body in a load-transferring manner. Accordingly the relatively thin-walled, substantially U-shaped shell body 21 as seen in cross section has an approximately β- (beta-) or M-shaped cross sectional contour, as shown schematically and by way of example in FIG. 5. A shell body 21 formed in this way owing to this relatively easily producible shaping has much better structural or dynamic properties. Said beta-form or wave form, which has two adjacent bulges running in longitudinal direction, which are curved in cross section and substantially parallel, is particularly advantageous with regard to the improved structural engineering characteristics or strength properties as well as in terms of production technology. This means that the almost U-shape of the shell body 21 mainly in the direction of its end sections can pass into a β- or almost M-shaped cross sectional contour, as shown by way of example from an overview of FIGS. 3 and 5. It is essential that the free edges or end sections of the relatively thin-walled shell body 21 run at least partly in the groove-like depressions 25, 26 on the upper side 7 of the sliding board body.

According to a preferred embodiment the shell body 21 comprises within a middle section or within its assembly section for a binding device 3—FIG. 1—a plurality of openings 32, 33. Said openings 32, 33 are formed within the central base section 27 in the shell body 21. The openings 32, 33 or corresponding groups of openings 32, 33 are provided for the passage of support elements 34, 35. Said support elements 34, 35 are provided for supporting a binding device 3—FIG. 1—in a load-transferring manner relative to the upper side 7 of the sliding board body. This means that the forces acting from the binding device 3 or from its guiding rail arrangement 15*a*, 15*b* are transferred by means of the support elements 34, 35 directly to the sliding board body or transferred directly to its upper side 7. In particular, through the openings 32, 33 in the shell body 21 in combination with the support elements 34, 35 passing through the latter the direct action of forces or torque stresses between the binding device 3 and the relatively thin-walled shell body 21 is avoided. In any case a large proportion of forces that act between the binding device 3 and the sliding board body, are transferred via the platform-like support elements 34, 35 through the shell body 21, without significant interaction or stresses between the binding device 3 and the upper side of the shell body 21. Since the support elements 34, 35 that are substantially pressure-resistant to the forces pass through the central base section 27 through corresponding openings 32, 33 the guiding rail arrangements 15*a*, 15*b* for a binding device 3 can be designed to be as compact as possible but still sufficiently stable, without there being serious limitations with regard to the assembly of different types of binding devices 3.

The height 36 of the support elements 34, 35 is in this case at least equal to or slightly greater than the wall thickness 22 of the shell body 21 in the section about its openings 32, 33. Preferably, the height 36 of the support elements 34, 35 is slightly greater than the wall thickness 22 around the openings 32, 33, so that from the binding device 3 to its guiding rail arrangement 15*a*, 15*b* no stresses and no significant pressure forces are exerted onto the shell body 21 in vertical direction to the running coating 10. Consequently, between the upper side of the shell body 21 and the under side of the guiding rail arrangement 15*a*, 15*b* there is a free space or a minimum gap 37 of at least 0.1 mm to 3 mm.

The support elements 34, 35 can be formed by integrally designed platform-like elevations on the upper side 7 of the sliding board body, which are formed in one piece with the sliding board body, as shown by way of example in the exemplary embodiment according to FIG. 2. This means that the platform-like elevations can be defined directly by the sliding board body in that its cover layer 8 forms platform-like elevations, which coincide or overlap with the openings 32, 33 in the shell body 21. According to an advantageous development, as illustrated in FIG. 4, the support elements 34, 35 are formed for supporting in a load-transferring manner a binding device 3 with a separate insertion part 38. Said insertion part 38 is arranged at least partly between the upper side 7 of the sliding board body and the lower side 16 of the shell body 21 and held in the intended relative position relative to the sliding board body and the shell body 21. Preferably, said insertion part 38 is designed such that it connects several support elements 34, 35, in particular a group of support elements 34, 35, to form a one-piece component group. Advantageously the insertion part 38 is designed such that it combines or groups the support elements 34, 35 for a front jaw body and a rear jaw body of the binding device 3, in particular with regard to their guiding rail arrangements 15*a*, 15*b*. This means that preferably for the front guiding rail arrangement 15*a* and for the rear guiding rail arrangement 15*b* an insertion part 38 is formed with several support elements 34, 35.

For reliably positioning or simplifying the assembly of the shell body 21 on the sliding board body it is expedient to mount the lower part section of the insertion part 38 in at least one corresponding depression 39 on the upper side 7 of the sliding board body and in this way to keep the insertion part 38 positioned relative to the sliding board body. The insertion part 38 can in this way comprise several support elements 34, 35, which are connected to one another by narrow connecting webs 40, whereby the corresponding connecting webs 40 run between the support elements 34, 35 in corresponding depressions 39 in the upper side 7 of the sliding board body, as shown by way of example in FIG. 4.

As shown best in FIGS. 2 and 4, the shell body 21 is secured in the assembly section for a binding device 3—FIG. 1—from lifting from the upper side 7 of the sliding board body, in that it is held between the lower side of a mounted binding device 3 or a mounted guiding rail arrangement 15*a*, 15*b* and the upper side 7 of the sliding board body. In addition the shell body 21 is passed through by the support elements 34, 35. This means that the shell body 21 is held in position by means of the support elements 21 in longitudinal direction relative to the sliding board body and in addition between the binding device 3 or its guiding rail arrangement 15*a*, 15*b* and the upper side 7 of the sliding board body, so that a vertical spacing or removal of the shell body 21 from the sliding board body is prevented. The determining of the position of the shell body 21 described above is thus affected such that the shell body 21 is held sliding freely relative to the lower side of a mounted binding device 3 in the direction of the longitudinal axis of the shell body 21 and preferably is secured in relation to the longitudinal direction of the shell body 21 at only one point or positioned relative to the sliding board body. This fixed point can be covered by the binding assembly centre point 15 or can be provided in the region of the front or rear guiding rail arrangement 15*a*, 15*b*. For example one of the openings 32, 33 or a corresponding pair of openings 32, 33 can be designed such that it is passed through essentially without play by the assigned support element 34, 35. In this way the mounting of the support body 21 can be play-free in longitudinal and transverse direction. A practical securing of the longitudinal position of the shell body 21 relative to the underlying sliding board body can also be achieved by at least one connecting zone 19 which is play-free in longitudinal direction and thus position fixing or also by at least one elastically flexible connecting zone 19. All other arrangements of support elements 34, 35 and assigned openings 32,*m* 33 relative to the longitudinal axis of the support body 21 are preferably selected such that in relation to the longitudinal direction of the support body 21 a free space or play is created which enables the equalisation of relative displacements caused by bending between the support elements 34, 35 and the support body 21, so that mutual straining between the support body 21 and the sliding board body are avoided as far as possible, if said entire unit of the sliding device 1 is subject to bending downwards or upwards. In particular a longitudinal extension of at least individual openings 32, 33 of the shell body 21 designed preferably in the form of an elongated hole can be greater than a longitudinal extension of the supporting element(s) 34, 35 corresponding therewith.

In this connection it is also essential that securing screws 41, 42 for the assembly of a binding device 3 or its guiding rail arrangement(s) 15*a*, 15*b* are anchored to be load-bearing solely in the sliding board body, as can best be seen in FIGS. 2 and 4. This means that the securing screws 41, 42 for the binding device 3 are not anchored in the shell body 21, but in the underlying sliding board body. Therefore, the respectively anchoring or tear-out forces for the securing screws 41, 42 are provided solely by the sliding board body or by its support elements 34, 35.

According to an advantageous embodiment the shell body 21 in side view—FIG. 1, 3—has a curved longitudinal extension. This means that its middle section is curved upwards in comparison to its end sections. In this way it is ensured that the distal end sections of the shell body 21 in the mounted state are supported with elastically flexible pretensioning on the upper side 7 of the sliding board body. In this way rattling noises or gaps between the upper side 7 of the sliding board body and the arms 23, 24 of the shell body 21 are reliably avoided even after a longer period of use or after frequent, intensive use. Furthermore, in this way the elastically restoring spring action of the substantially U-shaped shell body 21 can act on the upper side 7 of the sliding board body.

According to an advantageous development the lower side 16 of the relatively thin-walled shell body 21 can be provided or lined at least partially by a damping layer 43, in particular a fleece, as indicated schematically by dashed lines in FIG. 4. In this way rattling noises are avoided and sudden impulses are dampened, when the board-like sliding device 1 slides at high speeds and traverses rough ground. Furthermore, grinding or scratch lines are avoided on the upper side 7 of the sliding board body.

Overall it should be noted that the bending resistance of the sliding board body is much greater than the bending resistance of the shell body 21. By means of the aforementioned assembly measures and technical designs of the shell body 21 the shell body 21, if mounted on the upper side 21 of the sliding board body correctly, is mainly stressed by pressure or traction, when the entire sliding device 1 is subjected to bending downwards or upwards when in use. The shell body 21 stressed by pressure or traction in this case mainly influences with its resistance to compression and tension the bending resistance of the underlying sliding board body and thus the resulting bending resistance of the claimed sliding device 1, which is designed in particular as a ski or a snowboard.

In order to design the shell body 21 to be able to bear high stresses with regard to structural engineering and dynamic properties, but still achieve a light-weight structure the shell body 21 is formed by at least one layer of plastic. Preferably, the top layer of the shell body 21 is made from a thermoplastic material which is decorated by means of a sublimation or screen printing process. On the lower side of said thermoplastic cover layer facing the sliding board body, preferably at least one reinforcing layer, in particular a so-called prepreg-layer, is formed. It is essential that the shell body 21 is formed by at least one plastic layer which is substantially planar in its original state, which is shaped by means of a heating press into a shell or U-shaped moulding, as illustrated by way of example in FIG. 3. In particular a plastic ski which is substantially planar in the original state or a ski made of plastic composite material is shaped in a shaping pressing process by means of forming tools and is reshaped under the effect of heat into a shell body 21 with a corresponding shell or U-shape. Alternatively or in combination with this the shell body 21 can also be made from carbon materials, in particular carbon compound elements or fibrous materials. It is essential that the shell body 21 can resist the occurring compressive or pressure and tensile stresses and can be produced as easily and rapidly as possible.

The exemplary embodiments show possible embodiment variants of the board-like sliding device 1, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the board-like sliding device 1 the latter and its components have not been represented true to scale in part and/or have been enlarged and/or reduced in size.

The problem addressed by the independent solutions according to the invention can be taken from the description.

Mainly the individual embodiments shown in FIGS. 1-3; 4; 5 can form the subject matter of independent solutions according to the invention. The objectives and solutions according to the invention relating thereto can be taken from the detailed descriptions of these figures.

The invention claimed is:

1. A board-like sliding device in the form of a ski or snowboard, comprising a multi-layered sliding board body with a strength-relating upper layer, at least one strength-relating lower layer, at least one cover layer forming an upper side of the sliding board body having grooves arranged thereon, and at least one running surface coating forming a lower side of the sliding board body, a binding device for an optionally detachable connection with a sports shoe, and with at least one elongated force-transmitting element including side arms arranged at last partially within the grooves and supported on the upper side of the sliding board body for influencing the bending resistance or the vibrational behaviour of the sliding board body, and an engaging coupling means arranged between the lower side of the force-transmitting element and the upper side of the sliding board body, wherein the force-transmitting element is designed as a thin-walled shell body with a wall thickness of less than 5 mm, which has at least within the main part of its longitudinal extension a substantially U-shaped cross section.

2. The board-like sliding device according to claim 1, wherein the shell body comprises plastic, which is formed by means of a heating press into a shell or U-shaped moulding.

3. The board-like sliding device according to claim 1, wherein the lower side of the substantially U-shaped shell body is supported within the assembly section for a binding device in a load-transferring manner on the upper side of the sliding board body.

4. The board-like sliding device according to claim 1, comprising a cavity arranged at an end section of the shell body between the lower side of the shell body and the upper side of the sliding board body.

5. The board-like sliding device according to claim 1, comprising support elements for supporting in a load-transferring manner a binding device relative to the upper side of the sliding board body, the shell body within the assembly section for a binding device comprising a plurality of openings, support elements extend into respective ones of the openings.

6. The board-like sliding device according to claim 5, wherein the support elements comprise platform-like elevations on the upper side of the sliding board body designed to be integral with the sliding board body.

7. The board-like sliding device according to claim 5, wherein an insertion part is formed, which connects the support elements into a one piece component group, the sliding device further comprising an insertion part arranged between the upper side of the sliding board body and the lower side of the shell body.

8. The board-like sliding device according to claim 7, wherein a lower part section of the insertion part is held in position in depressions on the upper side of the sliding board body.

9. The board-like sliding device according to claim 1, wherein the shell body is secured within the assembly section for a binding device to prevent lifting from the upper side of the sliding board body, in that it is held between the underside of a mounted binding device and the upper side of the sliding board body.

10. The board-like sliding device according to claim 1, wherein the shell body is mounted to slide freely relative to the lower side of a mounted binding device in the direction of the longitudinal axis of the shell body.

11. The board-like sliding device according to claim 1, comprising securing screws anchored in a load-bearing manner for the assembly of a binding device only in the sliding board body.

12. The board-like sliding device according to claim 1, wherein the shell body in side view has a curved longitudinal extension, so that its distal end sections in the mounted state are supported by elastically flexible tensioning on the upper side of the sliding board body.

13. The board-like sliding device according to claim 1, wherein the bending resistance of the sliding board body is higher than the bending resistance of the shell body, and in that the shell body mounted on the upper side of the sliding board body is largely stressed by pressure or tension and thus influences the bending resistance or the vibrational behaviour of the ski or snowboard.

14. The board-like sliding device according to claim 1, wherein the side arms include end sections and are covered visually at least partly by side walls.

15. The board-like sliding device according to claim 1, wherein the force-transmitting element is connected to the sliding board body via a plurality of connecting zones spaced apart form one another in the longitudinal direction of the force-transmitting element.

16. The board-like sliding device according to claim 15, wherein within at least one connecting zone an elastically flexible connecting means is provided in the longitudinal direction of the sliding board body.

* * * * *